US005769741A

United States Patent [19]

Ritchie

[11] Patent Number: 5,769,741

[45] **Date of Patent: *Jun. 23, 1998**

[54] SPORT SWING TRAINING DEVICE

[76] Inventor: Gregory Ritchie, Box 933, Mineral, Va. 23117

[21] Appl. No.: 487,807

[22] Filed: Jun. 7, 1995

[ * ] Notice: The term of this patent shall not extend beyond the expiration date of Pat. No. 5,470,055.

Related U.S. Application Data

[63] Continuation-in-part of Ser. No. 264,698, Jun. 23, 1994, Pat. No. 5,470,055.

[51] Int. Cl.[6] ..... A63B 69/36

[52] U.S. Cl. ..... 473/422; 473/16

[58] Field of Search ..... 273/26 R, 29 A; 473/215, 216

[56] References Cited

U.S. PATENT DOCUMENTS

| | | | |
|---|---|---|---|
| 3,414,268 | 12/1968 | Chase | 273/211 |
| 3,595,583 | 7/1971 | Oppenheimer | 473/215 |
| 4,830,371 | 5/1989 | Lay | 273/26 E |
| 4,993,708 | 2/1991 | Prosser et al. | 273/26 R |
| 5,100,134 | 3/1992 | Becker | 273/26 R |
| 5,125,663 | 6/1992 | Lurowist | 473/216 |

*Primary Examiner*—Theatrice Brown

*Attorney, Agent, or Firm*—Fish & Richardson P.C.

[57] ABSTRACT

A swing training device is described, comprising a base assembly, a height adjustable stanchion on the base assembly and a spring for flexing built into the stanchion. An adjustable seat for steadying a hitter astride the stanchion, so as to help the hitter to perform a proper weight shift through the executing of a pre-swing stage and a swing stage for hitting a ball. Methods for training a tennis player using the swing training device are also described.

5 Claims, 6 Drawing Sheets

SPORT SWING TRAINING DEVICE

This is a continuation in part of application Ser. No. 08/264,698, filed Jun. 23, 1994, now U.S. Pat. No. 5,470,055 issued on Nov. 28, 1995, the contents of which are incorporated here by reference.

BACKGROUND OF THE INVENTION

The instant invention relates generally to sports training equipment and more specifically to a hitter's training device for use in baseball, golf, tennis, and other swing reliant sports.

Numerous sporting instruction equipment have been provided in prior art that are adapted to make players proficient with specialized instruction and practice to enhance their game performance. While these units may be suitable for the particular purpose to which they address, they would not be as suitable for the purposes of the present invention as hereinafter described.

SUMMARY OF THE INVENTION

A swing training device in accordance with the present invention includes a height adjustable stanchion affixed to a base assembly at one end and having a flexion point for permitting the stanchion to tip. An adjustable seat suitable for an athlete is rotatively secured to the stanchion permitting rotation during a swing.

A method for training an athlete in a swing-reliant sport in accordance with the present invention includes locating a stability providing seat in a predetermined practice location. The seat height is adjusted to force the athlete into an athletic stance while straddling the seat. Using the seat to maintain the athlete's hips at a predetermined height relative to the feet while providing a flexion point for allowing the seat to tip relative to a vertical axis, the player repeatedly executes swings using the seat.

Other features and advantages of the present invention will become readily apparent to those of ordinary skill in the art by reference to the following Detailed Description and accompanying drawings.

BRIEF DESCRIPTION OF THE DRAWING FIGURES

The Figures on the drawings are briefly described as follows.

DETAILED DESCRIPTION

Figure 2:
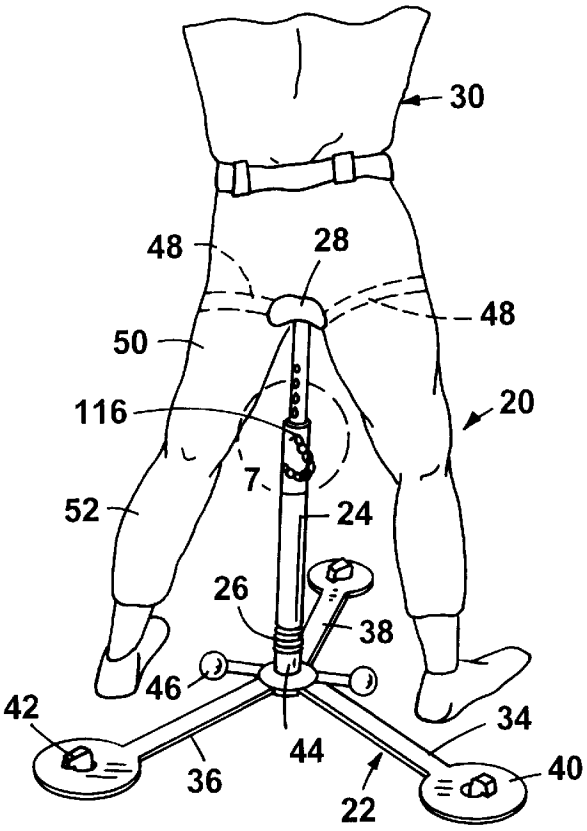
FIG. 2 is a rear perspective view.
Figure 3:
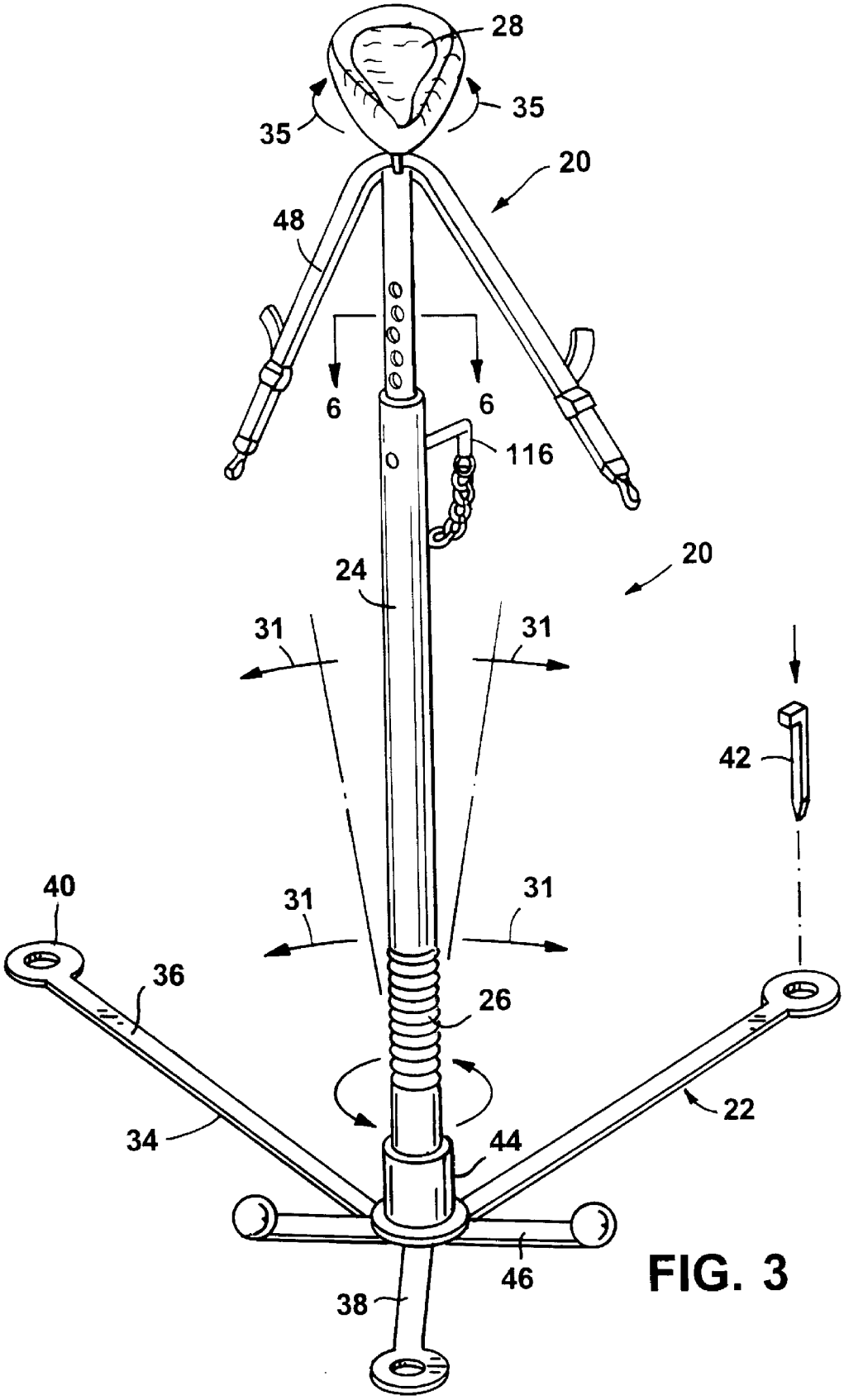
FIG. 3 is an enlarged front perspective view of the instant invention per se.
Figure 4:
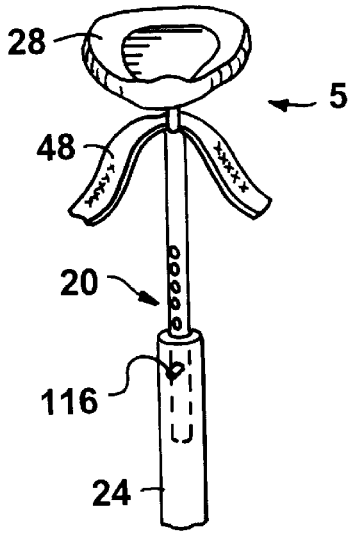
FIG. 4 is an enlarged front perspective view of an upper portion thereof, showing the seat structure.
Figure 5:
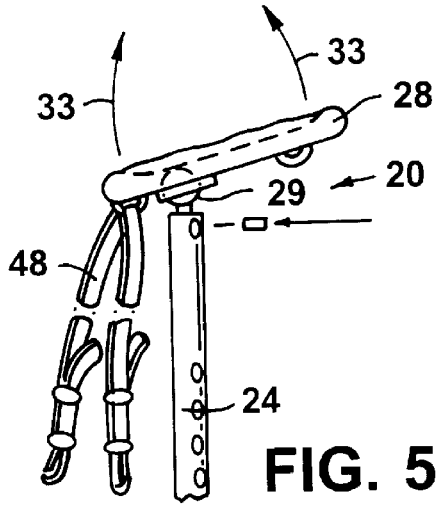
FIG. 5 is a side elevational view taken in the direction of arrow 5 in FIG. 4.
Figure 6:
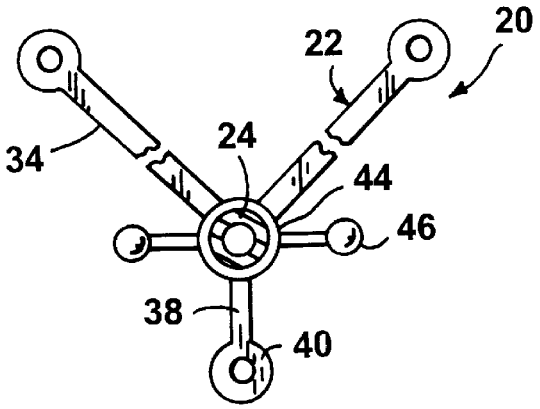
FIG. 6 is a cross section view taken on line 6—6 in FIG. 3.

Turning now descriptively to the drawings, in which similar reference characters denote similar elements throughout the several views, FIGS. 1 through 7 illustrate a swing training device 20 in accordance with one aspect of the present invention. Referring to FIG. 3, the swing training device includes a base assembly 22 and a height adjustable stanchion 24 which sits on the base assembly 22. A spring 26 for flexing is built into the stanchion 24, and permits the stanchion to tip about the spring as indicated by arrows 31. An adjustable seat 28 is provided for steadying a hitter 30 astride the stanchion 24, so as to help the hitter 30 to perform a proper weight shift through the execution of the pre-swing and swing phases. The seat 28 is effectively secured with a ball joint 29 to the stanchion 24 which permits the seat to automatically adjust to the user's rotative movement indicated by arrows 33, 35 but substantially forces the user to maintain a proper stance.

The base assembly 22 includes a tri-foot radial configuration 34 having two long rearwardly extending feet 36 and a short forwardly extending foot 38. Each foot 36, 38 has an eyelet shaped end 40, to receive a spike 42 to hold the feet 36, 38 securely on the ground. A collar 44 extends upwardly from the center of the tri-foot radial configuration 34, to receive a bottom end of the stanchion 24. A visual rotation indicator 46 extends horizontally across, between the two long feet 36 and the short foot 38, so that the hitter 30 can visually judge rotation throughout the swing. An adjustable strap 48 can be coupled to the seat 28, for securement about the thighs 50 of the legs 52 of the hitter 30, to maintain the hitter 30 upon the seat 28.

FIGS. 8 to 14 show a swing training device 60, adapted for use in golf training. A base assembly 62 supports a height adjustable stanchion 64 is on the base assembly 62. A spring 66 for flexing is built into the stanchion 64. A structure 68 is on the base assembly 62, for holding a golf ball 70 thereto. An adjustable seat 72 is for steadying a hitter 74 astride the stanchion 64, so as to help the hitter 74 to perform a proper weight shift through the executing of a pre-swing stage and a swing stage for hitting the golf ball 70 on the holding structure 68 with a golf club 76. An adjustable strap 48 can be coupled to the seat 28, for securement about the thighs 50 of the legs 52 of the hitter 30, to maintain the hitter 30 upon the seat 28.

The base assembly 62 includes a tri-foot radial configuration 78, having two long rearwardly extending feet 80 and a short forwardly extending foot 82. Each foot 80, 82 has an eyelet shaped end 84 to receive a spike 42 to hold the feet 80, 82 securely on the ground. A collar 86 extends upwardly from the center of the tri-foot radial configuration 78, to receive a bottom end of the stanchion 64. Two upstanding rails 88 are also provided, with each affixed onto each long foot 80, so that the holding structure 68 can be adjustable and connected to either of the rails 88.

The holding structure 68 contains a channel 90 to ride upon either of the rails 88, for a right handed and a left handed hitter 74. The channel 90 has a side threaded hole 92. A first L-shaped locking screw 94 having a threaded shank 96 engages with the side threaded hole 92 in the channel 90, to retain the channel 90 in a stationary position on upon either of the rails 88. A sleeve 98 is angularly mounted onto the channel 90. The sleeve 98 has a top threaded hole 100. An adjustable slide bar 102 fits through the sleeve 98. The slide bar 102 has a downwardly bent front portion 104 with an aperture 106 and a top cup-shaped recess 108 above the aperture 106 in a forward end of the front portion 104, to receive a golf tee 110 and the gold ball 70. A second L-shaped locking screw 112 having a threaded shank 114 engages with the top threaded hole 100 in the sleeve 98, to retain the slide bar 102 in a stationary position within the sleeve 98.

Figure 1:
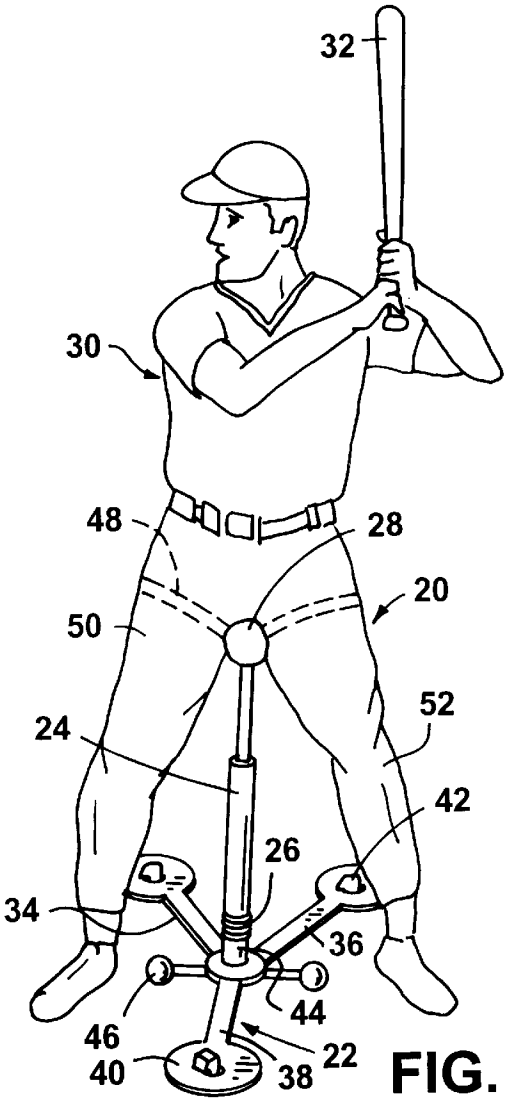
FIG. 1 is a front perspective view of a first embodiment of the instant invention in use by a baseball player.

The swing training device 20 may be used to train for any swing-reliant sport such as baseball, golf, handball, tennis, or any other racquet sport. Referring to FIG. 1, which depicts an athlete holding a baseball bat straddling the swing trainer 20, it is seen that the swing training device provides the player with balance. Balance is an important part of any athlete's ability to maneuver the body through the swing to properly hit a ball of any kind. The present invention provides stability of balance throughout the athletic maneuver thereby freeing the athlete to perfect all other mechanics of the swing such as weight transfer, linear and rotational movement of the hips and torso, as well as controlled head and eye movement. In any type of swing, controlled movement of the lower half of the body (waist to feet) is essential. The lower half of the body is the starting point of the athlete's balance, rhythm, power, and unlocks the upper half in order to strike the ball properly. The swing works sequentially from the feet to the head.

Figure 7:
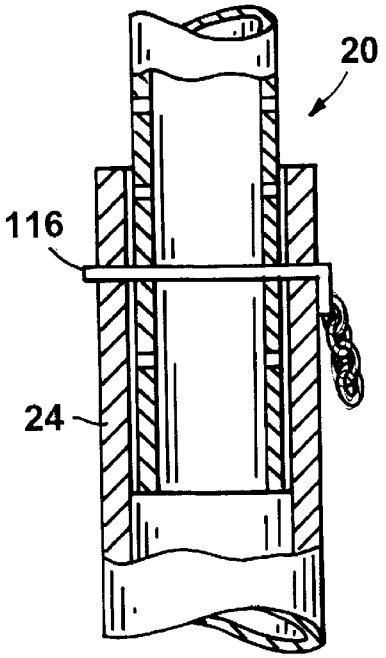
FIG. 7 is an enlarged elevational view partially in section as indicated by arrow 7 in FIG. 2.

Referring to FIG. 1 and FIG. 2, use of the swing training device 20 for baseball batting, will now be described. The hitter 30 places the base assembly 22 upon the ground and spikes 42 are driven into the ground through the eyelet shaped ends 40. The stanchion 24 is adjusted to its proper height and retained by a pin 116, as best seen in FIG. 7, so that the hitter 30 can be astride upon the seat 28. The adjustable straps 48 can be secured to the thighs 50 of the legs 52 of the hitter 30 to help the hitter improve his posturing when hitting the baseball.

Figure 8:
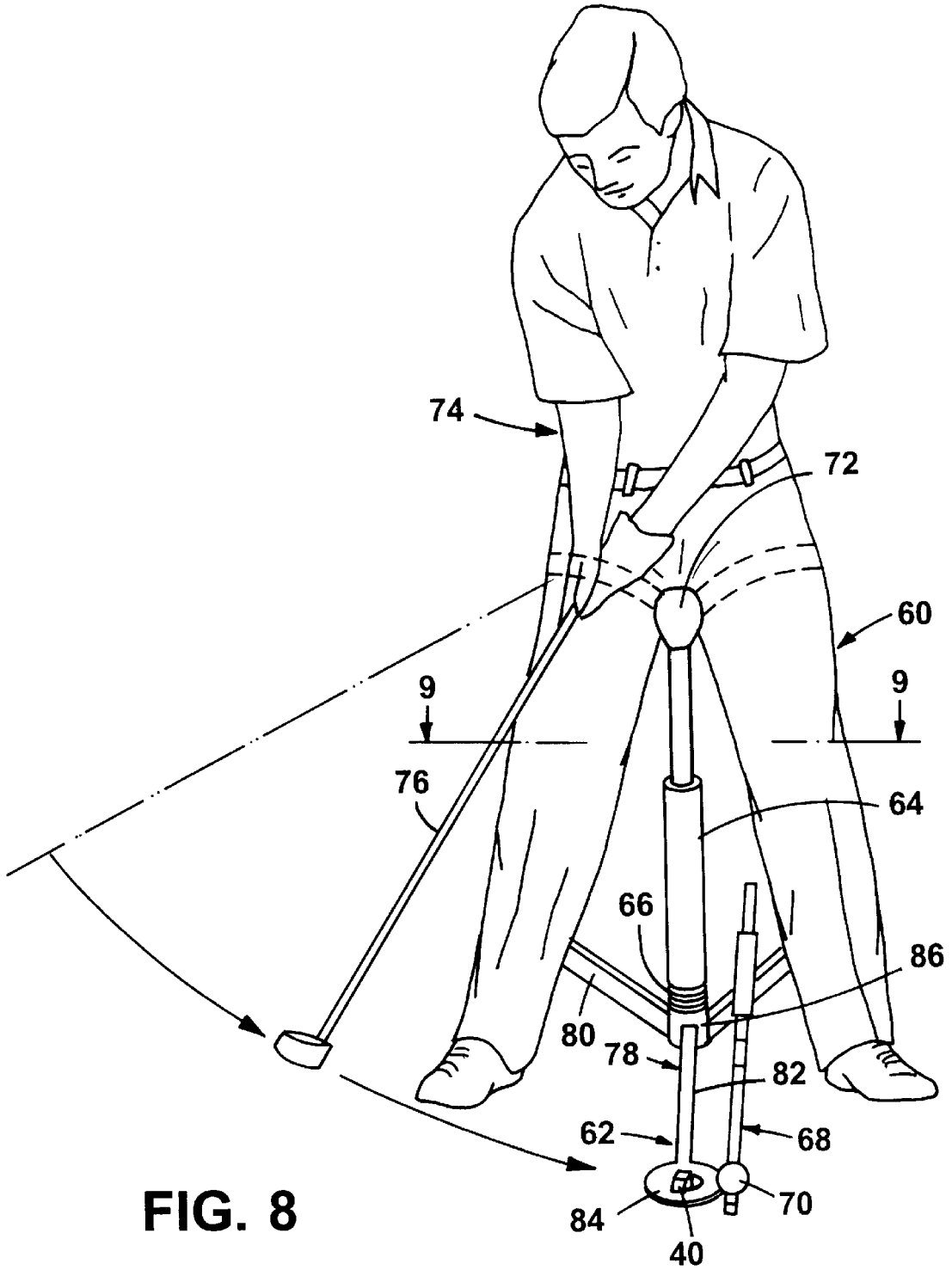
FIG. 8 is a front perspective view of a second embodiment of the instant invention in use by a golfer.
Figure 9:
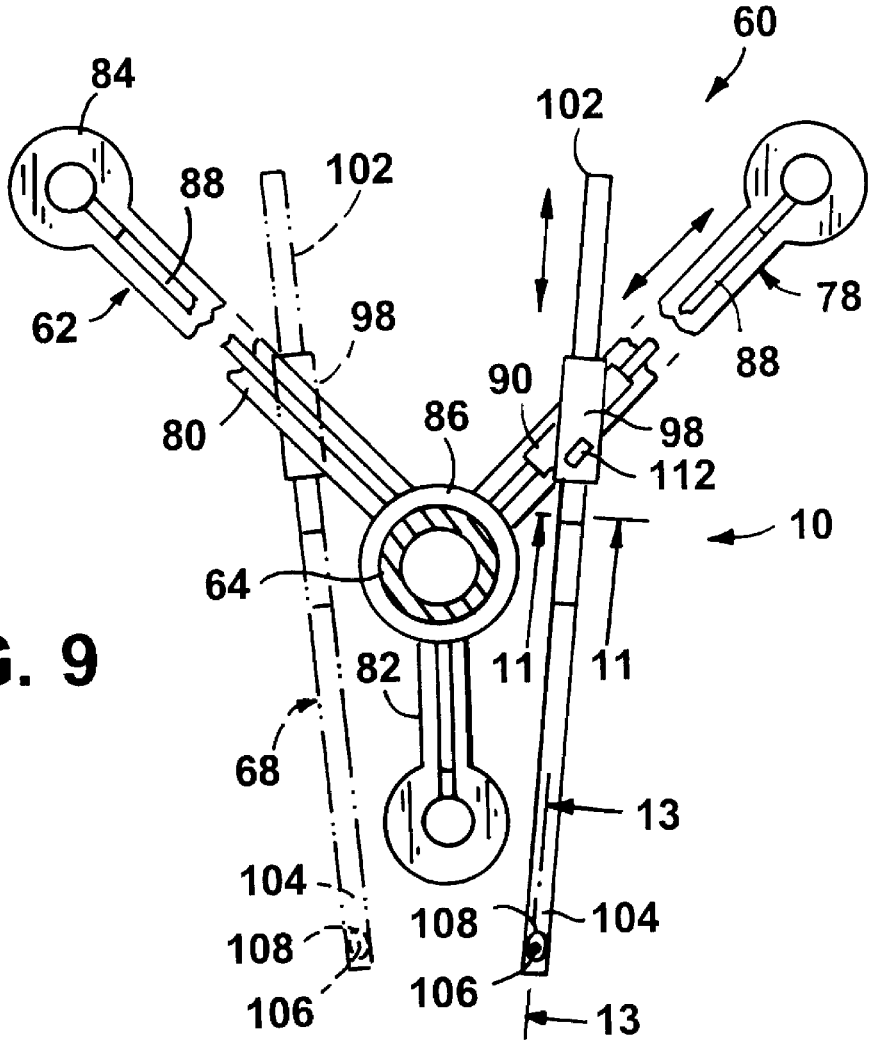
FIG. 9 is an enlarged cross sectional view taken on line 9—9 in FIG. 8.
Figure 10:
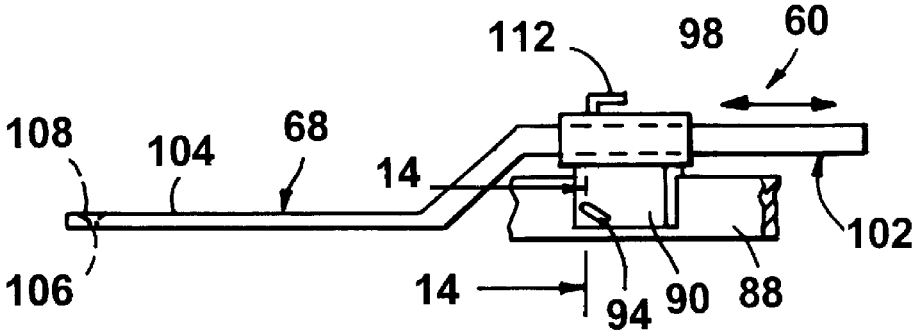
FIG. 10 is a side elevational view with parts broken away taken in the direction of arrow 10 in FIG. 9.
Figure 11:
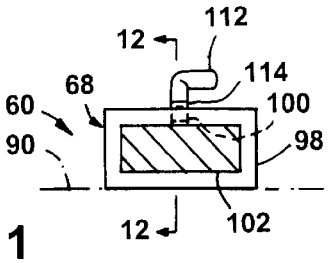
FIG. 11 is an enlarged cross sectional view with parts broken away taken on line 11—11 in FIG. 9.
Figure 12:
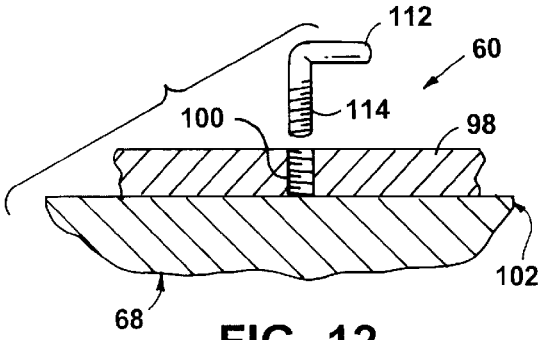
FIG. 12 is a still further enlarged cross section view with parts broken away taken on line 12—12 of FIG. 11.
Figure 13:
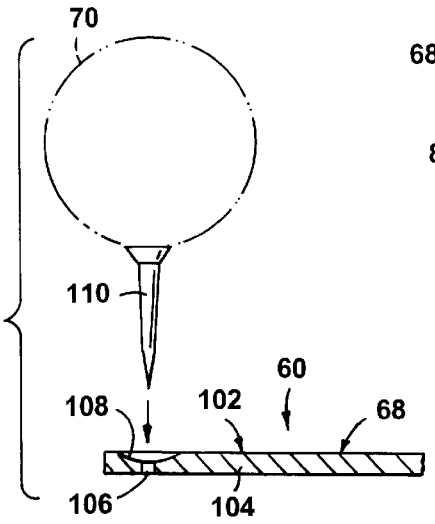
FIG. 13 is an enlarged cross sectional view taken on line 13—13 in FIG. 9, showing how a golf ball may be mounted with or without a golf tee thereto.
Figure 14:
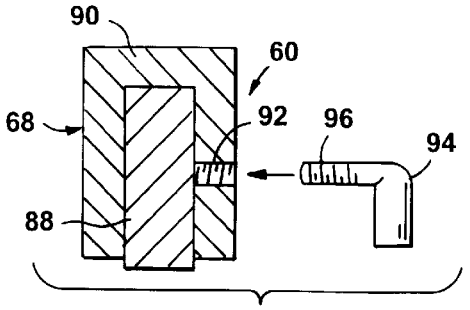
FIG. 14 is an enlarged cross section view taken on line 14—14 in FIG. 10.

Referring to FIG. 8, the use of the training device 60 for golf training will now be described. The base assembly 62 is placed upon the ground and spikes 42 are driven into the ground through the eyelet shaped ends 84. The stanchion 64 is adjusted to its proper height and retained by the pin 116, so that the hitter 74 can be astride upon the seat 72, with the holding structure 68 having already been mounted to either the right side or left side of the base assembly 62 and appropriately adjusted. The golf tee 110 and the golf ball 70 is then placed through the aperture 106 and top cup-shaped recess 108 in the front portion 104 of the slide bar 102.

The swing training, device 20, depicted in FIG. 1 through FIG. 8 may be used to train an athlete in tennis and other racquet sports also.

For practicing the tennis serve, the swing training device 20 is placed on the court with the seat and front leg 38 facing to the right side of the court for right-handed servers. The trainer is held in place using weights placed on top of the feet 40. Alternatively, bolts or spikes may be used to secure the feet to the ground or court surface. The seat height is adjusted using stanchion 24 and pin 116 to establish a comfortable stance for the server. The straps 48 are not used to train for the serve.

The player straddles the seat and maintains firm contact with the seat. The server then develops the serve rhythm by shifting the weight onto the front knee and then to the back knee as the arms come up. The swing training device 20 flexes at spring 26 to follow the movement while keeping a constant height and maintaining balance throughout the portion of the swing. At the end of the backward movement, the ball is tossed. Then the server shifts his weight forward bringing the racquet up toward the ball. As the server fully extends the rear leg he releases from the seat 28 following through the tennis ball. Throughout the above-described movement, the swing trainer 20 encourages proper rotation of the hips and torso throughout the swing by maintaining the hips at the proper height. Proper toss is also encouraged by limiting the range of movement of the server during the serve.

The hitter's seat 20 may be used for serve return drills to develop muscle memory in the player through repetition. The player may use the hitter's seat 20 to develop and practice the pre-serve rhythm and movement allowing quick reaction to a serve. Service returns may be practiced-by placing the trainer 20 on the ground or court with the seat and front leg 38 facing the net. The seat 20 is held in place by weights, bolts, or spikes. The seat height is adjusted using stanchion 24 and pin 116 to establish a comfortable stance for the player. For service returns a lower height is recommended to achieve a better line of sight on the ball during service. The straps 48 are placed loosely around the thighs. The straps should be resting on the lower thighs above the knee with the player in the athletic stance straddling the seat. This will allow the player to move toward the tennis ball coming slightly (about 1–2 feet) off the seat.

The player keeps contact with the hitter's seat while creating the proper pre-serve back and forth sideways rocking movement. Serves should be directed within 3 feet of the player for the service return exercise. As the tennis ball approaches, the player first pivots on the seat in the direction of the tennis ball getting the racquet into proper position. As the ball approaches the striking zone, the player rotates the seat toward the tennis ball then stepping into the ball with the opposite side foot. As the player steps toward the tennis ball, she will come off the seat in a level fashion. The straps 48 will tighten during this move, and the stanchion 24 will bend at the spring 26 toward the tennis ball. If the stanchion 24 does not bend towards the tennis ball, the player has moved incorrectly probably not staying level. The player uses her trailing legs to power the swing.

For practicing serves aimed directly at the player, the player rotates on the seat (in either direction forehand or backhand) then shifts her weight toward the back leg, and allowing the racquet head to clear in front to strike the ball. In this drill the player remains on the seat throughout the movement.

To practice ground strokes, the swing trainer 20 is placed to work on a particular area of the court. The seat and front leg 38 are positioned to face the side of the court and the trainer 20 is secured in place. The seat is set at the desired level to coincide with the hitter's stance for the particular bounce height being practiced. The straps are not used for this drill.

During the drill, the player walks or jogs up to (or is prepositioned on the seat) and straddles the trainer making contact with the seat in the selected forehand or backhand position. A tennis ball is delivered to the front side of the tennis player in a bouncing fashion. As the player rotates and shifts his weight into the tennis ball, contact with the seat is maintained. The tennis player should be on the seat and rotating toward the tennis ball as it bounces. The player on the seat finishes about ¾ of the rotation and shifts her weight toward the tennis ball as contact with the tennis ball is made. The stanchion 24 and spring(28 should bend toward the ball during this phase of the swing.

As the player continues to follow through with the stroke, contact with the seat is lost and the player's weight is shifted completely into the finish of the ground stroke. This drill encourages the player to stay level with respect to the tennis ball.

From the foregoing description, it will be apparent that an improved swing training device has been described. While a preferred embodiment and other embodiments have been described, it will be appreciated that variations and modifications in the herein described hitter's training seat, within the scope of the invention, will be apparent to those skilled in the art. Accordingly, the foregoing description should be taken as illustrative and not in a limiting sense.

I claim:

1. A swing training device comprising:

a) a base assembly;

b) a height adjustable stanchion on said base assembly;

c) a spring for flexing built into said stanchion permitting tipping of said stanchion;

d) an adjustable saddle suitable for supporting a player; and e) a ball joint rotatively securing said seat to said adjustable stanchion permitting said seat to rotate while steadying said player astride said stanchion, so as to help said player to perform a proper weight shift through the executing of a pre-swing stage and a swing stage for hitting a ball.

2. A swing training device as recited in claim 1, wherein said base assembly includes:

a) A tri-foot radial configuration having two long rearwardly extending feet and a short forwardly extending foot, with each said foot having an eyelet shaped end to receive a spike to hold said feet securely on the ground;

b) a collar extending upwardly from the center of said tri-foot radial configuration to receive a bottom end of said stanchion; and c) an indicator extending horizontally across, between said two long feet and said short foot, so that said player can visually judge rotation during the swing.

3. A swing training device as recited in claim 2, further comprising an adjustable strap coupled to said seat for securement about the thighs of the legs of said player, to maintain a predetermined relationship between said player and said seat.

4. A method for training a player to properly swing at a projectile in a swing reliant sport using a swing training device having a base assembly, a height adjustable stanchion on said base assembly, a spring for flexing built into said stanchion permitting tipping of(said stanchion, an adjustable seat suitable for supporting said player, and a joint rotatively securing said seat to said adjustable stanchion permitting said seat to rotate, the method comprising, locating said swing training device in a predetermined location for practicing said swing;

adjusting said seat height to enforce a predetermined athletic stance for said player while straddling said seat;

adjusting said swing training device to maintain the hips of said player at a predetermined height relative to the feet throughout at least a first portion of said swing;

having said player repeatedly execute practice swings using said seat said practice swings including a weight shift by said player while in contact with said seat causing flexion of said spring.

5. The method of claim 4 further comprising the step of:

securing said player to a predetermined relationship with said seat using adjustable straps affixed to said seat at a first end and removably affixed to said seat at a second end.

* * * * *